US006223628B1

(12) United States Patent
Barron

(10) Patent No.: US 6,223,628 B1
(45) Date of Patent: May 1, 2001

(54) LIGHT BULB REMOVER

(76) Inventor: Jesse O. Barron, 8558 Highcrest, Houston, TX (US) 77055

( * ) Notice: Subject to any disclaimer, the term of this patent is extended or adjusted under 35 U.S.C. 154(b) by 0 days.

(21) Appl. No.: 09/548,240

(22) Filed: Apr. 12, 2000

(51) Int. Cl.[7] ..... H01K 3/32

(52) U.S. Cl. ..... 81/53.11; 81/53.1; 294/19.1; 294/106

(58) Field of Search ..... 81/53.1, 53.11, 81/53.12; 294/19.1, 99.1, 103.1, 104, 106

(56) References Cited

U.S. PATENT DOCUMENTS

| | | | | |
|---|---|---|---|---|
| 1,482,147 | * | 1/1924 | Potts | 81/53.11 |
| 1,520,946 | * | 12/1924 | Grinnell | 81/53.11 |
| 2,191,593 | * | 2/1940 | Sosnik et al. | 81/53.11 |
| 2,357,104 | * | 8/1944 | Grinnell | 81/53.11 |
| 2,409,900 | * | 10/1946 | Riker et al. | 81/53.11 |
| 2,634,999 | * | 4/1953 | Fjeld | 81/53.11 |
| 3,101,212 | * | 8/1963 | Cater | 81/53.11 |
| 3,257,140 | * | 6/1966 | Lane | 81/53.11 |

* cited by examiner

*Primary Examiner*—Joseph J. Hail, III
*Assistant Examiner*—Joni B. Danganan

(57) ABSTRACT

A light bulb remover for removing and replacing light bulbs of various sizes. The light bulb remover includes a pole portion and a claw portion. The pole portion has a first end and a second end. The claw portion includes a base plate. The base plate has a top side, a bottom side and a peripheral wall extending therebetween. The base plate is removably securable to the second end of the pole portion. A plurality of finger portions is coupled to the base plate. Each of the finger portions is elongate and has a distal portion and a proximal portion. Each of the distal portions is coupled to the peripheral wall of the base plate such that each of the fingers extends upwardly above the top side. The finger portions are spaced from each other. A first of the finger portions has a break therein. The break is between the distal and proximal portions. The distal portion of the first finger portion is hingedly coupled to the proximal portion of the first finger portion. A biasing means biases the proximal portion of the first finger portion toward the other of the finger portions. A pulling means pulls the proximal portion of the first finger portion away the other finger portions.

18 Claims, 3 Drawing Sheets

LIGHT BULB REMOVER

BACKGROUND OF THE INVENTION

1. Field of the Invention

The present invention relates to light bulb replacing devices and more particularly pertains to a new light bulb remover for removing and replacing light bulbs of various sizes.

2. Description of the Prior Art

The use of light bulb replacing devices is known in the prior art. More specifically, light bulb replacing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,233,212; U.S. Pat. No. 2,766,060; U.S. Pat. No. 2,357,105; U.S. Pat. No. 5,317,939; U.S. Pat. No. 2,983,541; and U.S. Pat. No. 297,499.

While these devices fulfill their respective, particular objectives and requirements, the aforementioned patents do not disclose a new light bulb remover. The inventive device includes a pole portion and a claw portion. The pole portion has a first end and a second end. The claw portion includes a base plate. The base plate has a top side, a bottom side and a peripheral wall extending therebetween. The base plate is removably securable to the second end of the pole portion. A plurality of finger portions is coupled to the base plate. Each of the finger portions is elongate and has a distal portion and a proximal portion. Each of the distal portions is coupled to the peripheral wall of the base plate such that each of the fingers extends upwardly above the top side. The finger portions are spaced from each other. A first of the finger portions has a break therein. The break is between the distal and proximal portions. The distal portion of the first finger portion is hingedly coupled to the proximal portion of the first finger portion. A biasing means biases the proximal portion of the first finger portion toward the other of the finger portions. A pulling means pulls the proximal portion of the first finger portion away the other finger portions.

In these respects, the light bulb remover according to the present invention substantially departs from the conventional concepts and designs of the prior art, and in so doing provides an apparatus primarily developed for the purpose of removing and replacing light bulbs of various sizes.

SUMMARY OF THE INVENTION

In view of the foregoing disadvantages inherent in the known types of light bulb replacing devices now present in the prior art, the present invention provides a new light bulb remover construction wherein the same can be utilized for removing and replacing light bulbs of various sizes.

The general purpose of the present invention, which will be described subsequently in greater detail, is to provide a new light bulb remover apparatus and method which has many of the advantages of the light bulb replacing devices mentioned heretofore and many novel features that result in a new light bulb remover which is not anticipated, rendered obvious, suggested, or even implied by any of the prior art light bulb replacing devices, either alone or in any combination thereof.

To attain this, the present invention generally comprises a pole portion and a claw portion. The pole portion has a first end and a second end. The claw portion includes a base plate. The base plate has a top side, a bottom side and a peripheral wall extending therebetween. The base plate is removably securable to the second end of the pole portion. A plurality of finger portions is coupled to the base plate. Each of the finger portions is elongate and has a distal portion and a proximal portion. Each of the distal portions is coupled to the peripheral wall of the base plate such that each of the fingers extends upwardly above the top side. The finger portions are spaced from each other. A first of the finger portions has a break therein. The break is between the distal and proximal portions. The distal portion of the first finger portion is hingedly coupled to the proximal portion of the first finger portion. A biasing means biases the proximal portion of the first finger portion toward the other of the finger portions. A pulling means pulls the proximal portion of the first finger portion away the other finger portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new light bulb remover apparatus and method which has many of the advantages of the light bulb replacing devices mentioned heretofore and many novel features that result in a new light bulb remover which is not anticipated, rendered obvious, suggested, or even implied by any of the prior art light bulb replacing devices, either alone or in any combination thereof.

It is another object of the present invention to provide a new light bulb remover which may be easily and efficiently manufactured and marketed.

It is a further object of the present invention to provide a new light bulb remover which is of a durable and reliable construction.

An even further object of the present invention is to provide a new light bulb remover which is susceptible of a low cost of manufacture with regard to both materials and labor, and which accordingly is then susceptible of low prices of sale to the consuming public, thereby making such light bulb remover economically available to the buying public.

Still yet another object of the present invention is to provide a new light bulb remover which provides in the apparatuses and methods of the prior art some of the advantages thereof, while simultaneously overcoming some of the disadvantages normally associated therewith.

Still another object of the present invention is to provide a new light bulb remover for removing and replacing light bulbs of various sizes.

Yet another object of the present invention is to provide a new light bulb remover which includes a pole portion and a claw portion. The pole portion has a first end and a second end. The claw portion includes a base plate. The base plate has a top side, a bottom side and a peripheral wall extending therebetween. The base plate is removably securable to the second end of the pole portion. A plurality of finger portions is coupled to the base plate. Each of the finger portions is elongate and has a distal portion and a proximal portion. Each of the distal portions is coupled to the peripheral wall of the base plate such that each of the fingers extends upwardly above the top side. The finger portions are spaced from each other. A first of the finger portions has a break therein. The break is between the distal and proximal portions. The distal portion of the first finger portion is hingedly coupled to the proximal portion of the first finger portion. A biasing means biases the proximal portion of the first finger portion toward the other of the finger portions. A pulling means pulls the proximal portion of the first finger portion away the other finger portions.

Still yet another object of the present invention is to provide a new light bulb remover that has a telescoping pole portion for reaching light bulbs at various heights.

Even still another object of the present invention is to provide a new light bulb remover that has a finger portion having a break therein for the accommodation of different sized light bulbs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
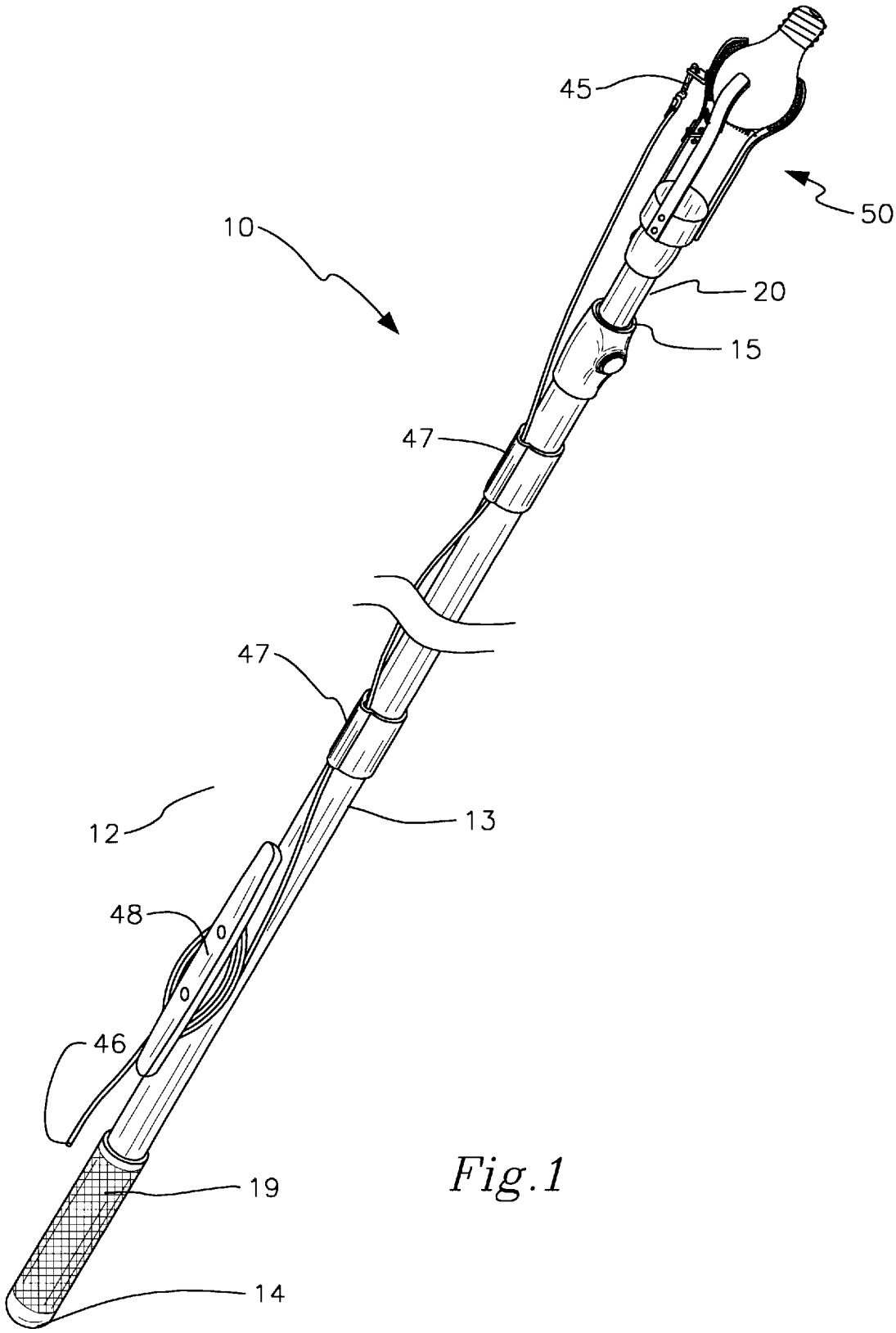
FIG. 1 is a schematic perspective view of a new light bulb remover according to the present invention.
Figure 2:
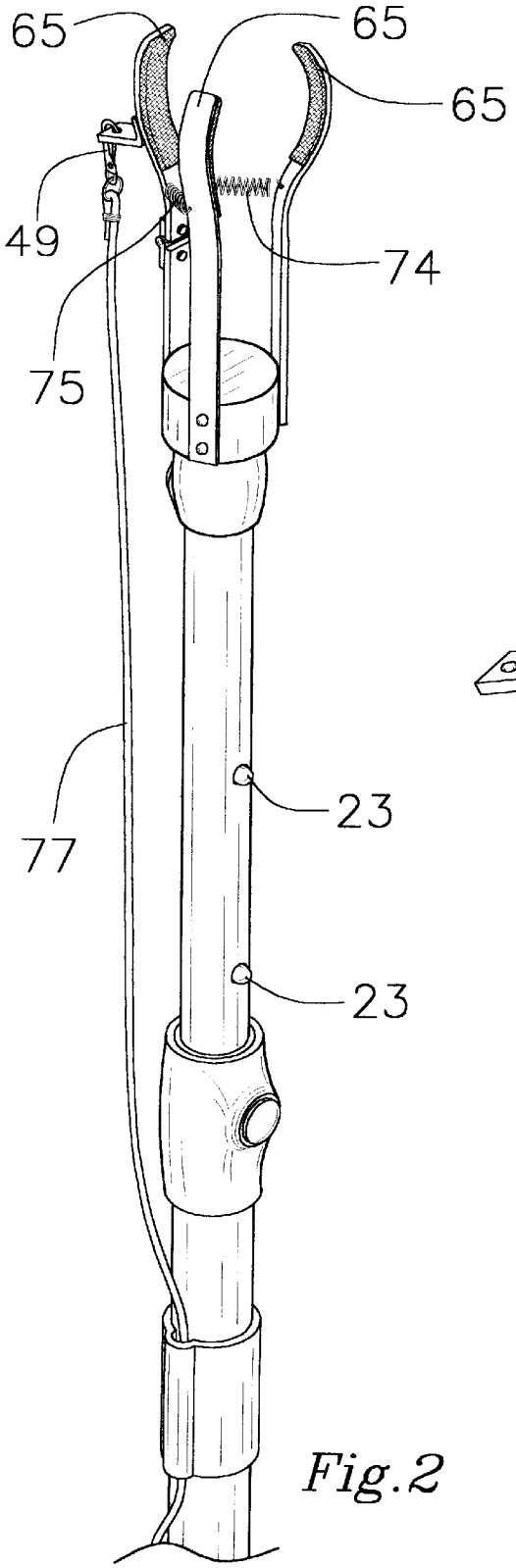
FIG. 2 is a schematic perspective view of the present invention.
Figure 3:
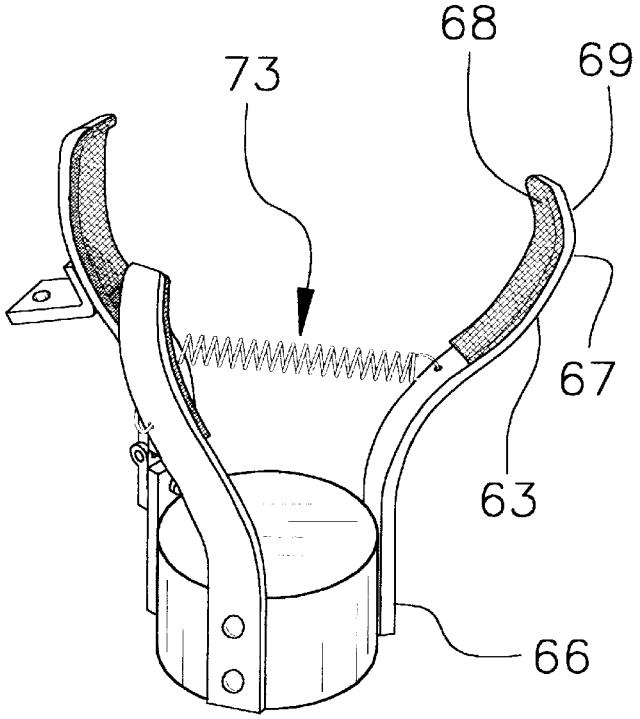
FIG. 3 is a schematic exploded perspective view of the claw portion of the present invention.
Figure 4:
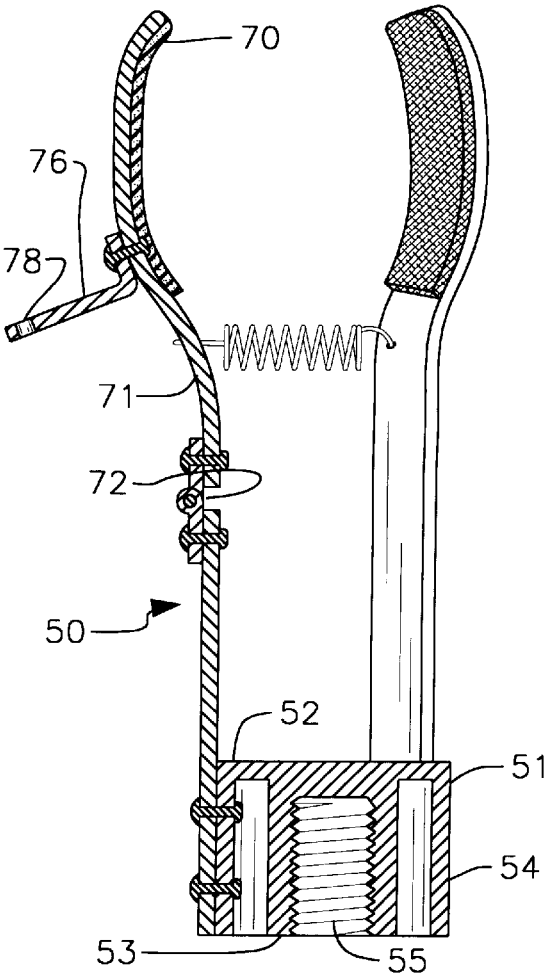
FIG. 4 is a schematic cross-sectional view of the claw portion of the present invention.
Figure 6:
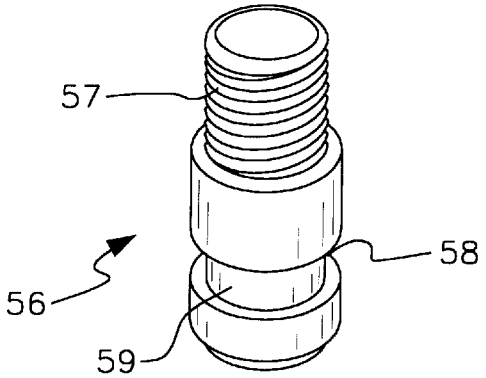
FIG. 6 is a schematic perspective view of the coupling rod of the present invention.
Figure 5:
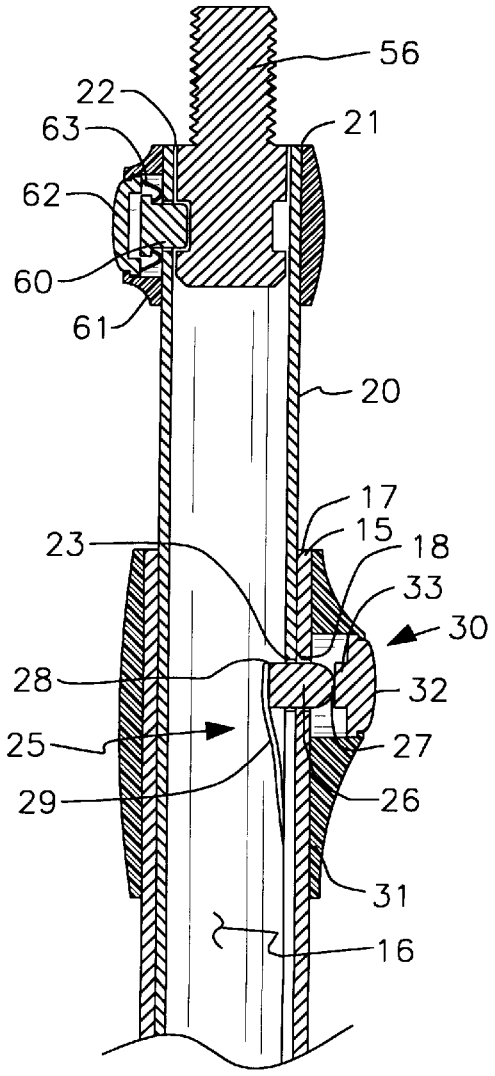
FIG. 5 is a schematic cross-sectional view of the pole portion of the present invention.

With reference now to the drawings, and in particular to FIGS. 1 through 6 thereof, a new light bulb remover embodying the principles and concepts of the present invention and generally designated by the reference numeral 10 will be described.

As best illustrated in FIGS. 1 through 6, the light bulb remover 10 generally comprises a pole portion 12 and a claw portion 50 attached to the pole portion.

The pole portion 12 comprises a telescoping pole portion comprising a first tubular member 13 and a second tubular member 20. The first tubular member 13 has a first end 14 and a second end 15. The first tubular member has a lumen 16 therein. The second end 15 has an opening 17 extending into the lumen 16. The first tubular member 13 has a bore therein 18. The bore 18 is generally adjacent to the second end 15. A handle member 19 is coupled to the first tubular member 13. The handle member 19 is generally adjacent to the first end 14 of the first tubular member and comprises a conventional handle member.

The second tubular member 20 has a first end, not shown, and a second end 21. The second tubular member 20 has a lumen therein 16 as well. The second end 21 has an opening 22 extending into the lumen 16. The second tubular member 20 has a plurality of holes 23 therein. The holes 23 are spaced and extend generally along a line between the first and second 21 ends.

The second tubular member 20 is slidably insertable in the first tubular member 13 through the opening 17 in the second end 15 of the first tubular member 13.

A securing means 25 removably secures the first tubular member 13 to the second tubular member 20 so that the first and second tubular members may be selectively secured at a certain length. The securing means 25 comprises a plurality of lugs 26. Each of the lugs has a top edge 27 and a bottom edge 28. Each of the lugs 26 is positioned in one of the holes 23 in the second tubular member 20 such that the top edges 27 are directed away from the lumen 16. A plurality of biasing means 29 bias the top edges 27 away from the lumen 16. Each of the biasing means 29 is coupled to one of the bottom edges 28 of the lugs 26. The biasing means 29 ideally comprise a thin and elongate portion of metal having a first end coupled to the bottom edge and a second edge coupled to an interior surface of the second tubular member generally adjacent to and on the same side of the respective lug. However, springs extending across the lumen 16 of the second tubular 20 member would also work.

A button portion 30 selectively disengages the securing means. The button portion comprises a shoulder 31 and a button 32 slidably mounted in the shoulder 31. The shoulder 31 is positioned around the bore 18 in the first tubular member 13. The button 32 is slidably mounted in the shoulder 31. The lugs 26 may extend through the bore 18 in the first tubular member 13 such that the button 32 may be pressed against the top edge 27 of the lugs 26 to remove the lugs 26 from the bore 18. The shoulder 31 has an exterior edge having a lip thereon. The button slides about the opening created by the shoulder, and has a peripheral edge having a greater diameter than the distance across the lip such that the button may not leave the shoulder. The button has a protrusion 33 thereon. The protrusion 33 has a size adapted to fit in the bore 18 so that the protrusion 33 can push the lug 26 completely out of the bore 18 and thereby allow the second tubular member 20 to slide with respect to the first tubular member 13.

The claw portion 50 has a base plate 51. The base plate 51 has a top side 52, a bottom side 53 and a peripheral wall 54 extending therebetween. The bottom side 53 has well 55 therein. The well 55 has an internal surface which is threaded. The base plate 51 is generally disc-shaped and has a circular top and bottom side.

A coupling means 56 removably couples the base plate 51 to the second end 21 of the second tubular member 20. The coupling means 56 comprises a rod having a first portion 57 and a second portion 58. The first portion 57 has a threaded surface and is adapted for being received by the well 55. The second portion 58 has a surface having an annular channel 59 therein. A protruding member 60 is slidably mounted in the second tubular member 20 and is positioned generally adjacent to the second end 21 of the second tubular member 20. The protruding member 60 is biased into the second tubular member 20 such that the protruding member 60 may communicate with the annular channel 59. The protruding member 60 is within a shoulder 61, much like the button portion. The protruding member has a button 62 over it. Two U-shaped biasing members 63 are placed within the shoulder 61 between the shoulder 61 and the protruding member 60. The U-shaped members 63 have a first end in communication with a lip on the protruding member 60 and a second end in communication with the button 62. When the button 62 is pressed the protruding member 60 is pushed out of the opening it occupies so that the rod may be released.

A plurality of finger portions 65 may be used. Each of the finger portions is elongate and has a distal portion 66 and a proximal portion 67. Each of the distal portions 66 is coupled to the peripheral wall 54 of the base plate 51 such that each of the fingers 65 extends upwardly above the top side 52. The finger portions 65 are spaced from each other. Each of the proximal portions 67 is curved such that each of the proximal portions has a concave inside surface 68 and a convex outside surface 69. Each of the concave inside surfaces 68 has a gripping material 70 thereon. The gripping material 70 comprises a foamed elastomeric material. The gripping material also acts a cushion for protecting the light bulb. The plurality of finger portions is ideally a first 71, second and third finger portions. The first finger portion 71 has a break 72 therein. The break 72 is between the distal 66 and proximal 67 portions. The distal portion 66 of the first finger portion 71 is hingedly coupled to the proximal portion 67 of the first finger portion 71 such that the proximal portion 67 may pivot away from the second and third finger portions.

A biasing means 73 biases the proximal portion of the first finger portion 71 toward the second and third finger portions. The biasing means 73 comprises a pair of springs 74, 75. A first 74 of the springs is coupled to and extends between the proximal portion 67 of the first finger portion 71 and the proximal portion 67 of the second finger portion. A second 75 of the springs is coupled to and extends between the proximal portion of the first finger portion 71 and the proximal portion of the third finger portion.

A pulling means pulls the proximal portion of the first finger portion away from the second and third finger portions. The pulling means comprises a bracket member 16 and an elongate flexible member 77. The bracket member 76 is coupled to and extends away from the exterior surface 69 of the proximal portion 67 of the first finger portion 71. The bracket member 76 is generally L-shaped has a leg portion and a foot portion. The foot portion is coupled to the exterior surface so that the leg portion can extend away from the proximal portion of the first finger portion. The bracket member 76 has an aperture 78 therein. The aperture 78 is generally adjacent to a free end of the bracket 76. The elongate flexible member 77 ideally comprises a cord, though any conventional rope or cable may be used, having a first end 45 and a second end 46. The first end 45 is coupled to the aperture 78 in the bracket member 76. A plurality of sleeves 47 guides the elongate flexible member 77 along the length of the first tubular member 13. A second bracket member 48 is attached to the first tubular member 13 generally adjacent to the handle member 19 for wrapping the cord around for storage. The first end 45 of the cord has a clasp 49 thereon so that the cord can be released from the first finger portion 71.

In use, the tubular members are extended to a length deemed necessary for reaching the light bulb. The respective lug is allowed to enter the bore in the first elongate member so that the two tubular members no longer move with respect to each other. The user then pulls on the cord to pull the proximal portion of one of the fingers back to open the space between the fingers. When the fingers are around the light bulb, the proximal portion is allowed to pivot back so that all fingers are in communication with the light bulb. The pole portion is rotated to remove the light bulb and the opposite is performed to place another light bulb in the socket. Since the proximal portion of the first finger is pivotally coupled, the claw portion may be used for different sized light bulbs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A light bulb changing device, said device comprising:

a pole portion having a first end and a second end;

a claw portion, said claw portion comprising:

a base plate, said base plate having a top side, a bottom side and a peripheral wall extending therebetween, said base plate being removably securable to said second end of said pole portion;

a plurality of finger portions, each of said finger portions being elongate and having a distal portion and a proximal portion, each of said distal portions being coupled to said peripheral wall of said base plate such that each of said fingers extend upwardly above said top side, said finger portions being spaced from each other, a first of said finger portions having a break therein, said break being between said distal and proximal portions, said distal portion of said first finger portion being hingedly coupled to said proximal portion of said first finger portion;

a biasing means for biasing said proximal portion of said first finger portion toward the other of said finger portions; and a pulling means for pulling said proximal portion of said first finger portion away from the other of said finger portions;

wherein said pole portion comprises:

a first tubular member, said first tubular member having a first end and a second end, said tubular member having a lumen therein, said second end having an opening extending into said lumen, a second tubular member, said second tubular member having a first end and a second end, said second tubular member having a lumen therein, said second end having an opening extending into said lumen, wherein said second tubular member is slidably insertable in said first tubular member through said opening in said second end of said first tubular member;

wherein a securing means selectively secures said first tubular member with respect to said second tubular member; and wherein said base plate is removably coupled to said second end of said second tubular member;

wherein said securing means comprises:

said first tubular member having a bore therein, said bore being generally adjacent to said second end;

said second tubular member having a plurality of holes therein, said holes being spaced and extending generally along a line between said first and second ends;

a plurality of lugs, each of said lugs having a top edge and a bottom edge, each of said lugs being positioned in one of said holes in said second tubular member such that said top edges are directed away from said lumen, a plurality of biasing means bias said top edges away from said lumen, each of said biasing means being coupled to one of said bottom edges of said lugs, wherein each of said lugs may extend into said bore in said first tubular member;

a button portion for selectively disengaging said securing means, said button portion comprising a shoulder and a button slidably mounted in said shoulder, said shoulder being positioned around said bore in said first tubular member.

2. The light bulb changing device as in claim 1, further comprising:

said bottom side of said base plate having well therein, said well having an internal surface being threaded; and a coupling means for removably coupling said base plate to said second end of said second tubular member, said coupling means comprising a rod having a first portion and a second portion, said first portion having a threaded surface and being adapted for being received by said well, said second portion having a surface having an annular channel therein, a protruding member being slidably mounted in said second tubular member and positioned generally adjacent to said second end of said second tubular member, said protruding member being biased into said second tubular member such that said protruding member may communicate with said annular channel.

3. The light bulb changing device as in claim 1, wherein said finger portions further comprise:

each of said proximal portions being curved such that each of said proximal portions have a concave inside surface and an convex outside surface, each of said concave inside surfaces having a gripping material thereon, said gripping material comprising a foamed elastomeric material.

4. The light bulb changing device as in claim 1, said plurality of finger portions including first, second and third finger portions.

5. The light bulb changing device as in claim 4, wherein said biasing means comprises:

a pair of springs, a first of said springs being coupled to and extending between said proximal portion of said first finger portion and said proximal portion of said second finger portion, a second of said springs being coupled to and extending between said proximal portion of said first finger portion and said proximal portion of said third finger portion.

6. The light bulb changing device as in claim 5, wherein said pulling means comprises:

a bracket member and an elongate flexible member, said bracket member being coupled to and extending away from said exterior surface of said proximal portion of said first finger portion, said bracket member having an aperture therein, said aperture being generally adjacent to a free end of said bracket, said elongate flexible member comprising a cord having a first end and a second end, said first end being coupled to said aperture in said bracket member.

7. The light bulb changing device as in claim 1, wherein said pulling means comprises:

a bracket member and an elongate flexible member, said bracket member being coupled to and extending away from said proximal portion of said first finger portion, said bracket member having an aperture therein, said aperture being generally adjacent to a free end of said bracket, said elongate flexible member comprising a cord having a first end and a second end, said first end being removably coupled to said aperture in said bracket member.

8. A light bulb changing device comprising:

a pole portion having a first end and a second end;

a claw portion comprising:

a base having a top, a bottom and a periphery extending therebetween, said base being removably securable to said second end of said pole portion;

a plurality of finger portions, each of said finger portions being elongate and having a distal portion and a proximal portion, each of said distal portions being coupled to said periphery of said base such that each of said fingers extend upwardly above said top of said base, said finger portions being spaced from each other, a first of said finger portions having a break therein, said break being between said distal and proximal portions, said distal portion of said first finger portion being hingedly coupled to said proximal portion of said first finger portion, said plurality of finger portions including first, second and third finger portions;

a biasing means for biasing said proximal portion of said first finger portion toward the other of said finger portions; and a pulling means for pulling said proximal portion of said first finger portion away from the other of said finger portions;

wherein said biasing means comprises a pair of springs, a first of said springs being coupled to and extending between said proximal portion of said first finger portion and said proximal portion of said second finger portion, a second of said springs being coupled to and extending between said proximal portion of said first finger portion and said proximal portion of said third finger portion.

9. The light bulb changing device as in claim 8, wherein said pulling means comprises a bracket member and an elongate flexible member, said bracket member being coupled to and extending away from said exterior surface of said proximal portion of said first finger portion, said bracket member having an aperture therein, said aperture being generally adjacent to a free end of said bracket, said elongate flexible member comprising a cord having a first end and a second end, said first end being coupled to said aperture in said bracket member.

10. The light bulb changing device as in claim 8, wherein said pole portion comprises:

a first tubular member having a first end and a second end, said tubular member having a lumen therein, said second end having an opening extending into said lumen, a second tubular member having a first end and a second end, said second tubular member having a lumen therein, said second end having an opening extending into said lumen, wherein said second tubular member is slidably insertable in said first tubular member through said opening in said second end of said first tubular member;

wherein a securing means selectively secures said first tubular member with respect to said second tubular member; and wherein said base is removably coupled to said second end of said second tubular member.

11. The light bulb changing device as in claim 10, wherein said securing means comprises:

a bore therein in said first tubular member, said bore being generally adjacent to said second end;

a plurality of holes in said second tubular member, said holes being spaced and extending generally along a line between said first and second ends;

a plurality of lugs, each of said lugs having a top edge and a bottom edge, each of said lugs being positioned in one of said holes in said second tubular member such that said top edges are directed away from said lumen, a plurality of biasing means bias said top edges away from said lumen, each of said biasing means being coupled to one of said bottom edges of said lugs, wherein each of said lugs may extend into said bore in said first tubular member;

a button portion for selectively disengaging said securing means, said button portion comprising a shoulder and a button slidably mounted in said shoulder, said shoulder being positioned around said bore in said first tubular member.

12. The light bulb changing device as in claim 10, wherein said bottom of said base has a well formed therein, said well having an internal surface with threads formed thereon, and including a coupling means for removably coupling said base to said second end of said second tubular member, said coupling means comprising a rod having a first portion and a second portion, said first portion having a threaded surface and being adapted for being received by said well, said second portion having a surface having an annular channel therein, a protruding member being slidably mounted in said second tubular member and positioned generally adjacent to said second end of said second tubular member, said protruding member being biased into said second tubular member such that said protruding member may communicate with said annular channel.

13. The light bulb changing device as in claim 8, wherein each of said proximal portions of said finger portions being curved such that each of said proximal portions have a concave inside surface and an convex outside surface, each of said concave inside surfaces having a gripping material thereon.

14. A light bulb changing device comprising:

a pole portion having a first end and a second end;

a claw portion comprising:

a base having a top, a bottom and a periphery extending therebetween, said base being removably securable to said second end of said pole portion;

a plurality of finger portions, each of said finger portions being elongate and having a distal portion and a proximal portion, each of said distal portions being coupled to said periphery of said base such that each of said fingers extend upwardly above said top of said base, said finger portions being spaced from each other, a first of said finger portions having a break therein, said break being between said distal and proximal portions, said distal portion of said first finger portion being hingedly coupled to said proximal portion of said first finger portion, said plurality of finger portions including first, second and third finger portions;

a biasing means for biasing said proximal portion of said first finger portion toward the other of said finger portions; and a pulling means for pulling said proximal portion of said first finger portion away from the other of said finger portions;

wherein said pole portion comprises:

a first tubular member having a first end and a second end, said tubular member having a lumen therein, said second end having an opening extending into said lumen, a second tubular member having a first end and a second end, said second tubular member having a lumen therein, said second end having an opening extending into said lumen, wherein said second tubular member is slidably insertable in said first tubular member through said opening in said second end of said first tubular member;

wherein a securing means selectively secures said first tubular member with respect to said second tubular member; and wherein said base is removably coupled to said second end of said second tubular member; and wherein said bottom of said base has a well formed therein, said well having an internal surface with threads formed thereon, and including a coupling means for removably coupling said base to said second end of said second tubular member, said coupling means comprising a rod having a first portion and a second portion, said first portion having a threaded surface and being adapted for being received by said well, said second portion having a surface having an annular channel therein, a protruding member being slidably mounted in said second tubular member and positioned generally adjacent to said second end of said second tubular member, said protruding member being biased into said second tubular member such that said protruding member may communicate with said annular channel.

15. The light bulb changing device as in claim 14, wherein each of said proximal portions of said finger portions being curved such that each of said proximal portions have a concave inside surface and an convex outside surface, each of said concave inside surfaces having a gripping material thereon.

16. The light bulb changing device as in claim 14, wherein said plurality of finger portions including first, second and third finger portions.

17. The light bulb changing device as in claim 16, wherein said biasing means comprises a pair of springs, a first of said springs being coupled to and extending between said proximal portion of said first finger portion and said proximal portion of said second finger portion, a second of said springs being coupled to and extending between said proximal portion of said first finger portion and said proximal portion of said third finger portion.

18. The light bulb changing device as in claim 17, wherein said pulling means comprises a bracket member and an elongate flexible member, said bracket member being coupled to and extending away from said exterior surface of said proximal portion of said first finger portion, said bracket member having an aperture therein, said aperture being generally adjacent to a free end of said bracket, said elongate flexible member comprising a cord having a first end and a second end, said first end being coupled to said aperture in said bracket member.

* * * * *